US012313271B2

(12) United States Patent
Long et al.

(10) Patent No.: US 12,313,271 B2
(45) **Date of Patent: *May 27, 2025**

(54) OVERFLOW SENSOR ASSEMBLY IN TEMPERATURE CONTROL SYSTEMS

(71) Applicant: Rheem Manufacturing Company, Atlanta, GA (US)

(72) Inventors: Robert L. Long, Fort Smith, AR (US); Kenneth D. Frederick, Fort Smith, AR (US); Kevin M. Ray, Fort Smith, AR (US); Karl S. Tallakson, Greenwood, AR (US); Sivakumar Gopalnarayanan, Plano, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/407,989

(22) Filed: Jan. 9, 2024

(65) Prior Publication Data

US 2024/0142126 A1 May 2, 2024

Related U.S. Application Data

(63) Continuation of application No. 17/986,674, filed on Nov. 14, 2022, now Pat. No. 11,906,183, which is a continuation of application No. 16/684,224, filed on Nov. 14, 2019, now Pat. No. 11,530,829.

(60) Provisional application No. 62/767,400, filed on Nov. 14, 2018.

(51) Int. Cl.
*F24F 11/32* (2018.01)
*F24F 13/22* (2006.01)

(52) U.S. Cl.
CPC ..... *F24F 11/32* (2018.01); *F24F 13/222* (2013.01); *F24F 2013/227* (2013.01)

(58) Field of Classification Search
CPC .. F25D 11/02; F25D 2201/12; F25D 2201/14; F25D 23/02; F25D 23/06; F25D 23/063; F25D 23/069; F25D 2600/04
See application file for complete search history.

(56) References Cited

U.S. PATENT DOCUMENTS

| | | | | |
|---|---|---|---|---|
| 3,088,016 | A | 4/1963 | Mertler et al. | |
| 4,037,427 | A | 7/1977 | Kramer | |
| 4,075,863 | A | 2/1978 | Wilson | |
| 5,027,610 | A | 7/1991 | Hara | |
| 5,212,958 | A | 5/1993 | Anderson | |
| 5,272,918 | A * | 12/1993 | Gaston | G01F 23/64 73/317 |
| 5,984,281 | A | 11/1999 | Hacker et al. | |

(Continued)

*Primary Examiner* — Filip Zec
(74) *Attorney, Agent, or Firm* — Eversheds Sutherland (US) LLP

(57) ABSTRACT

Embodiments include overflow sensor assemblies for water heaters, HVAC systems, and other devices for which temperature control systems may be used. An example overflow sensor assembly for detecting fluid leaks at a device may include a sensor probe configured to be in electrical communication with a power supply, and a sensor mounting bracket that forms a ground, where the sensor mounting bracket is configured to be adjustably coupled to a mounting surface on the device, such that the sensor mounting bracket can deflect about the mounting surface. The sensor probe is suspended from the sensor mounting bracket.

20 Claims, 9 Drawing Sheets

(56) References Cited

U.S. PATENT DOCUMENTS

| | | | | |
|---|---|---|---|---|
| 6,257,758 | B1 | 7/2001 | Culbertson | |
| 7,067,750 | B1 * | 6/2006 | Cantolino | H01H 35/18 200/84 R |
| 7,896,301 | B1 * | 3/2011 | Cantolino | G01F 23/38 248/228.2 |
| 8,151,580 | B1 * | 4/2012 | Cantolino | H01H 29/04 62/150 |
| 8,151,621 | B1 * | 4/2012 | Cantolino | G01F 25/20 73/1.73 |
| 8,156,956 | B1 | 4/2012 | Coogle | |
| 8,887,392 | B1 * | 11/2014 | Xu | F24F 13/22 29/890.035 |
| 9,423,148 | B2 * | 8/2016 | Oakner | F24F 13/222 |
| 9,469,517 | B2 | 10/2016 | Willis | |
| 9,644,887 | B2 | 5/2017 | Chung et al. | |
| 9,816,867 | B2 | 11/2017 | Ishikawa et al. | |
| 10,113,916 | B2 | 10/2018 | Hong et al. | |
| 10,545,039 | B2 | 1/2020 | Lake et al. | |
| 10,731,895 | B2 | 8/2020 | Young et al. | |
| 11,385,090 | B2 | 7/2022 | Maguire et al. | |
| 2006/0005312 | A1 * | 1/2006 | Reddy | G01F 23/243 4/668 |
| 2006/0208912 | A1 | 9/2006 | Fiorletta et al. | |
| 2007/0169501 | A1 | 7/2007 | Rios | |
| 2008/0245802 | A1 | 10/2008 | Gray | |
| 2009/0026894 | A1 | 1/2009 | Lesmeister et al. | |
| 2009/0190630 | A1 | 7/2009 | Hong et al. | |
| 2010/0052921 | A1 | 3/2010 | Cantolino | |
| 2011/0061415 | A1 | 3/2011 | Ward | |
| 2013/0218483 | A1 | 8/2013 | Sawyer | |
| 2015/0233769 | A1 | 8/2015 | Ishikawa et al. | |
| 2015/0323241 | A1 | 11/2015 | Oakner et al. | |
| 2016/0123651 | A1 | 5/2016 | Barbely et al. | |
| 2018/0108461 | A1 | 4/2018 | Rostron et al. | |
| 2020/0011740 | A1 | 1/2020 | Mohammad et al. | |
| 2020/0393306 | A1 | 12/2020 | Yoshihara et al. | |

* cited by examiner

OVERFLOW SENSOR ASSEMBLY IN TEMPERATURE CONTROL SYSTEMS

CROSS-REFERENCE TO RELATED APPLICATIONS

This application is a continuation of U.S. application Ser. No. 17/986,674, filed Nov. 14, 2022, which is a continuation of U.S. application Ser. No. 16/684,224, filed Nov. 14, 2019 and issued as U.S. Pat. No. 11,530,829, which claims the benefit of U.S. Provisional Patent Application No. 62/767,400, filed Nov. 14, 2018. The full disclosure of each application is incorporated by reference herein in its entirety and for all purposes.

TECHNICAL FIELD

The present disclosure relates generally to temperature control systems, and more particularly to an overflow sensor assembly in a temperature control system, such as a heating, ventilation, and air-conditioning (HVAC) unit.

BACKGROUND

Conventional HVAC units utilize a drain pan for collection and removal of condensation. Condensation may refer to the water formed on the evaporator coil during the operation of the HVAC units, e.g., air conditioning operation. The drain pan is typically situated below the evaporator coil to collect the condensate and direct the condensate fluid to a drain, e.g., via a condensate drain line. Unfortunately, over a period of time the drain line may become clogged due to algae, fungus, airborne debris entering the line, house settling, and so forth. If the drain lines clog, the condensate fluid may start to fill the drain pan. If left undetected, the condensate fluid may overflow the drain pan and cause costly structural and property damage, e.g., damage to household goods, furnishings, floors, carpet, walls, ceiling of the structure, etc., as well as damage to the HVAC units (e.g., blower motor).

Typically, conventional HVAC units are provided with a float switch that is either coupled to or disposed in the drain pan to detect the rising level of the condensate fluid in the drain pan and shut off the HVAC unit prior to an overflow of the condensate fluid from the drain pan. Shutting off the HVAC unit stops any further production of condensate fluid, thereby preventing the overflow of the condensate fluid from the drain pan and any resultant structural or property damages. The float switch can be used when the drain pan is a fixed drain pan. However, when the drain pan is configured to be removable, for example configured to slide in and out for easy cleaning, maintenance, and/or troubleshooting, the float switch may interfere with removal of the drain pan and/or may get damaged. For example, when the removable drain pan slides out, a portion of the drain pan may engage or strike the float switch causing the drain pan to get stuck, thereby preventing an easy or smooth removal from and/or insertion of the drain pan to the HVAC unit. Further, when the drain pan engages or strikes said float switch, the positioning of the float switch may be altered, or the lead wires to the float switch may get disconnected, and/or the float switch may get damaged.

This background information is provided to reveal information believed to be of possible relevance to the present disclosure. No admission is necessarily intended, nor should be construed, that any of the preceding information constitutes prior art against the present disclosure.

SUMMARY

In one aspect, the present disclosure relates to an overflow sensor assembly of an HVAC unit. The overflow sensor assembly includes a sensor mounting bracket that is configured to be coupled to a mounting surface on the HVAC unit such that sensor probes that are disposed thereon are suspended within and extend into a condensate drain pan of the HVAC unit. The sensor probes are configured to activate an overflow detection circuit when the sensor probes come in contact with condensate fluid collected in the condensate drain pan prior to the condensate fluid overflowing from the condensate drain pan. Each sensor probe is defined by a sensor element and a spring that is coupled to the sensor element.

In another aspect, the present disclosure relates to an overflow sensor assembly of an HVAC unit. The overflow sensor assembly includes a sensor mounting bracket that is configured to be coupled to a mounting surface on the HVAC unit. Further, the overflow sensor assembly includes a first sensor probe defined by a portion of the sensor mounting bracket, and a second sensor probe defined by a termination of a wire that is coupled to the sensor mounting bracket using wire tabs. The portion of the sensor mounting bracket and the termination of the wire are suspended within and extend into a condensate drain pan of the HVAC unit and are configured to activate an overflow detection circuit when the sensor mounting bracket and the termination of the wire come in contact with condensate fluid collected in the condensate drain pan prior to the condensate fluid overflowing from the condensate drain pan.

In yet another aspect, the present disclosure relates to an HVAC apparatus that includes a condensate drain pan assembly. The condensate drain pan assembly is disposed in a drain pan cavity of the HVAC apparatus to collect condensate from an evaporator of the HVAC apparatus. The condensate drain pan is configured to slide in and slide out of the drain pan cavity. Further, the HVAC apparatus includes an overflow sensor assembly that is coupled to a frame of the HVAC apparatus such that at least one sensor probe of the overflow sensor assembly is suspended within and extends into the condensate drain pan of the HVAC apparatus to activate an overflow detection circuit when the at least one sensor probe encounters condensate fluid collected in the condensate drain pan prior to the condensate fluid overflowing from the condensate drain pan, wherein the overflow sensor assembly is flexible.

These and other aspects, features, and embodiments of the disclosure will become apparent to a person of ordinary skill in the art upon consideration of the following brief description of the figures and detailed description of illustrated embodiments.

BRIEF DESCRIPTION OF THE FIGURES

The foregoing and other features and aspects of the present disclosure are best understood with reference to the following description of certain example embodiments, when read in conjunction with the accompanying drawing, wherein.

Figure 1:
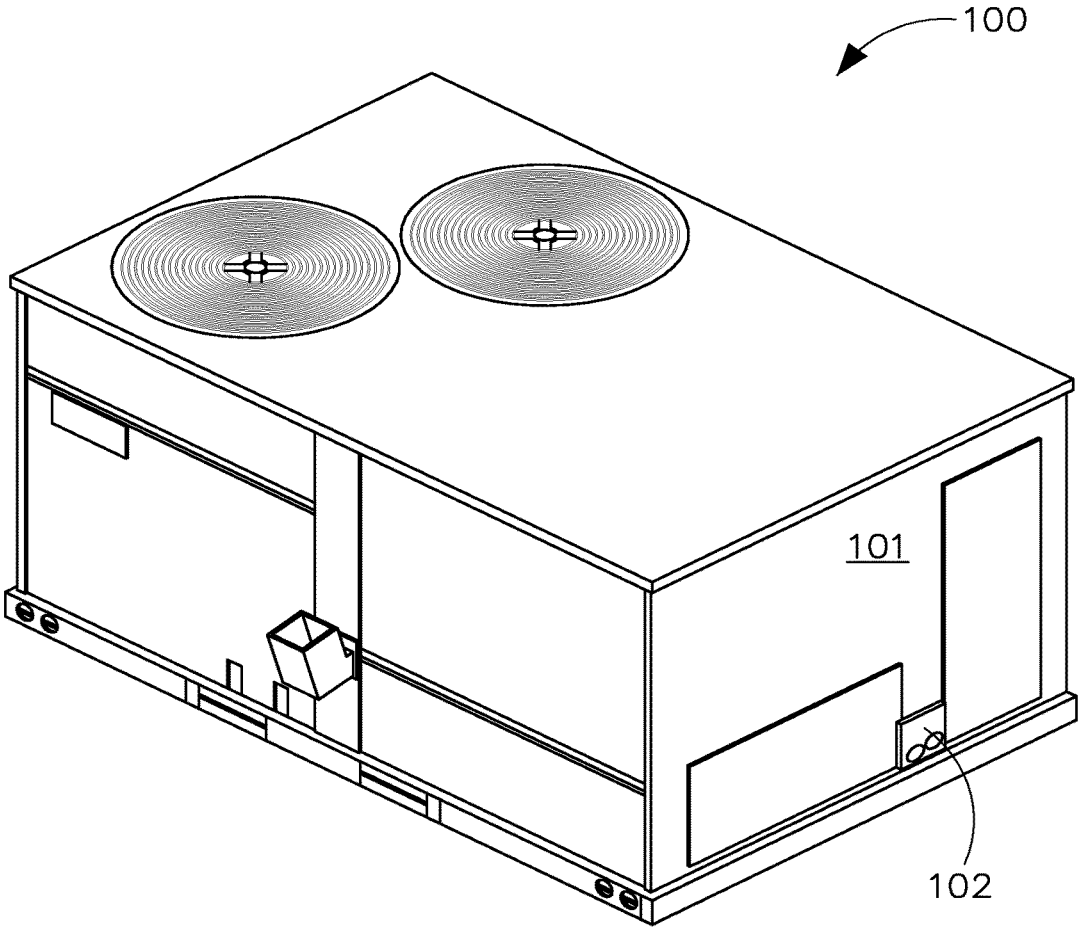
FIG. 1 illustrates a perspective front view of an example HVAC unit, in accordance with example embodiments of the present disclosure.
Figure 2:
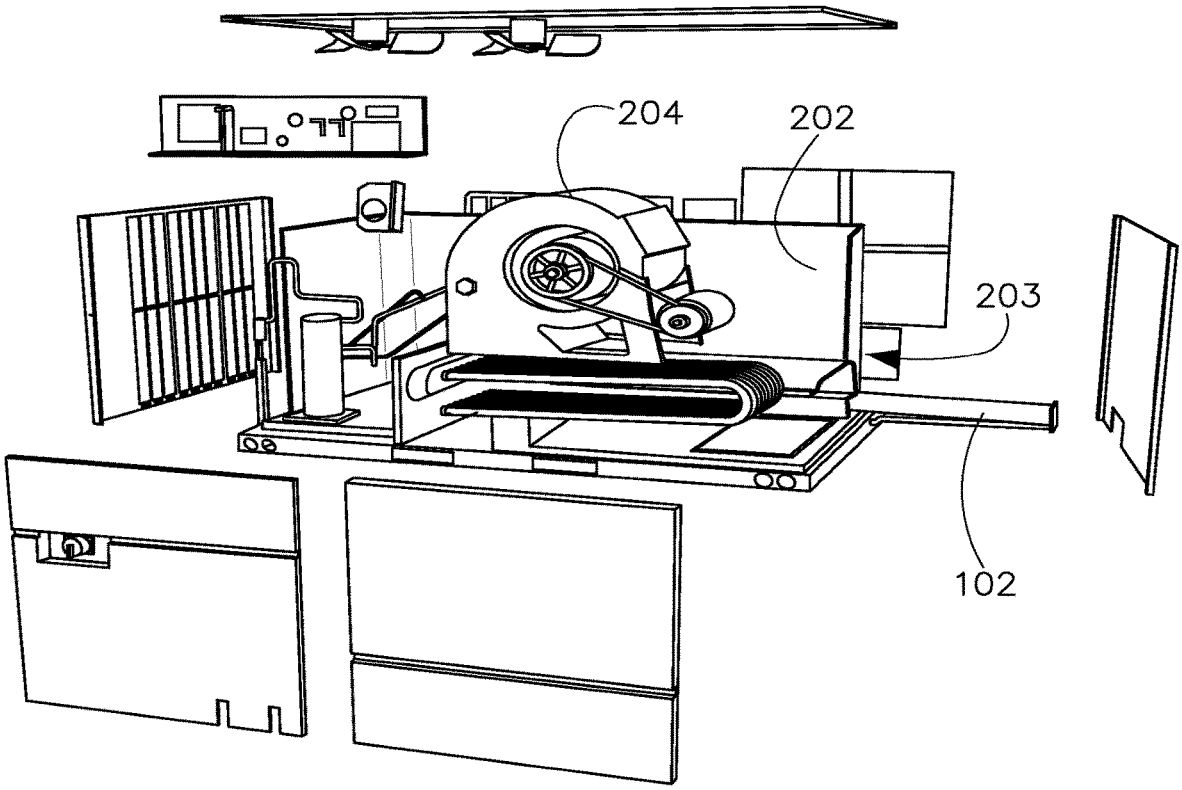
FIG. 2 is an exploded view of a portion of the HVAC unit of FIG. 1, in accordance with example embodiments of the present disclosure.

The drawings illustrate only example embodiments of the present disclosure and are therefore not to be considered limiting of its scope, as the present disclosure may admit to other equally effective embodiments. The elements and features shown in the drawings are not necessarily to scale, emphasis is instead placed on clearly illustrating the principles of the example embodiments. Additionally, certain dimensions or positions may be exaggerated to help visually convey such principles.

DETAILED DESCRIPTION OF EXAMPLE EMBODIMENTS

The present disclosure describes an overflow sensor assembly that is disposed in a removable condensate drain pan of an HVAC unit to detect a level of condensate in the drain pan and determine if the condensate in the drain pan is near overflow. In certain embodiments, the overflow sensor assembly is flexible to allow the removable condensate drain pan to be easily removed, e.g., to slide in and out. In one such embodiment, the overflow sensor assembly includes probes that are suspended from a bracket that is mounted above the drain pan, where the probes are configured to sense condensate (e.g., water) through electrical continuity. The probes may be screws with metal springs that are coupled thereto and extending from the screws such that the metal springs move when it interferes or engages with the removable drain pan.

Example embodiments of an HVAC unit with the overflow sensor assembly will be described more fully hereinafter with reference to the accompanying drawings that describe representative embodiments of the present technology. If a component of a figure is described but not expressly shown or labeled in that figure, the label used for a corresponding component in another figure can be inferred to that component. Conversely, if a component in a figure is labeled but not described, the description for such component can be substantially the same as the description for a corresponding component in another figure. Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

The overflow sensor assembly of the present disclosure may be embodied in many different forms and should not be construed as limited to the embodiments set forth herein; rather, these embodiments are provided so that this disclosure will be thorough and complete, and will fully convey the scope of the technology to those appropriately skilled in the art. Further, example embodiments of the overflow sensor assembly of the present disclosure can be disposed in an HVAC unit that is located in any type of environment (e.g., warehouse, attic, garage, storage, mechanical room, basement) for any type (e.g., commercial, residential, industrial) of user. Furthermore, even though the present disclosure describes the overflow sensor assembly as being used in HVAC units, one of skill in the art can understand and appreciate that the overflow sensor assembly can be used with any other appropriate temperature control systems that has removable drain pans for collecting condensate and sensor probes for detecting a condensate overflow condition without departing from a broader scope of the present disclosure.

Referring to FIGS. 1-5 and 8, an HVAC unit 100 of the present disclosure may include a removable drain pan assembly 102 that is configured to be disposed in a drain pan cavity 310 (illustrated in FIG. 3) that is located below evaporator coils 202 of the HVAC unit 100. The drain pan assembly 102 may be configured to slide in and slide out of a drain pan cavity 310. In certain embodiments, the removable drain pan assembly 102 may include a drain pan front cover 304, a condensate drain pan 302, and a drain line 305. The drain pan front cover 304 may be configured to provide leverage to a user to pull or slide out the removable drain pan assembly 102 from the drain pan cavity 310 as desired, e.g., for cleaning, maintenance, etc. The condensate drain pan 302 may be configured to collect condensate from the evaporator coils 202 in a cavity 312 defined by the condensate drain pan 302. Further, the condensate drain pan 312 may be configured to direct the collected condensate fluid to a drain on the side of the HVAC unit 100, e.g., via the drain line 305.

In addition to the drain line 305, the removable drain pan assembly 102 may include a center drain tube 306. In some example embodiments, the drain line 305 may be coupled to the center drain tube 305 using a connector tube (not shown) to drain the condensate fluid collected in the condensate drain pan 302 though an opening below the HVAC unit 100.

Figure 3A:
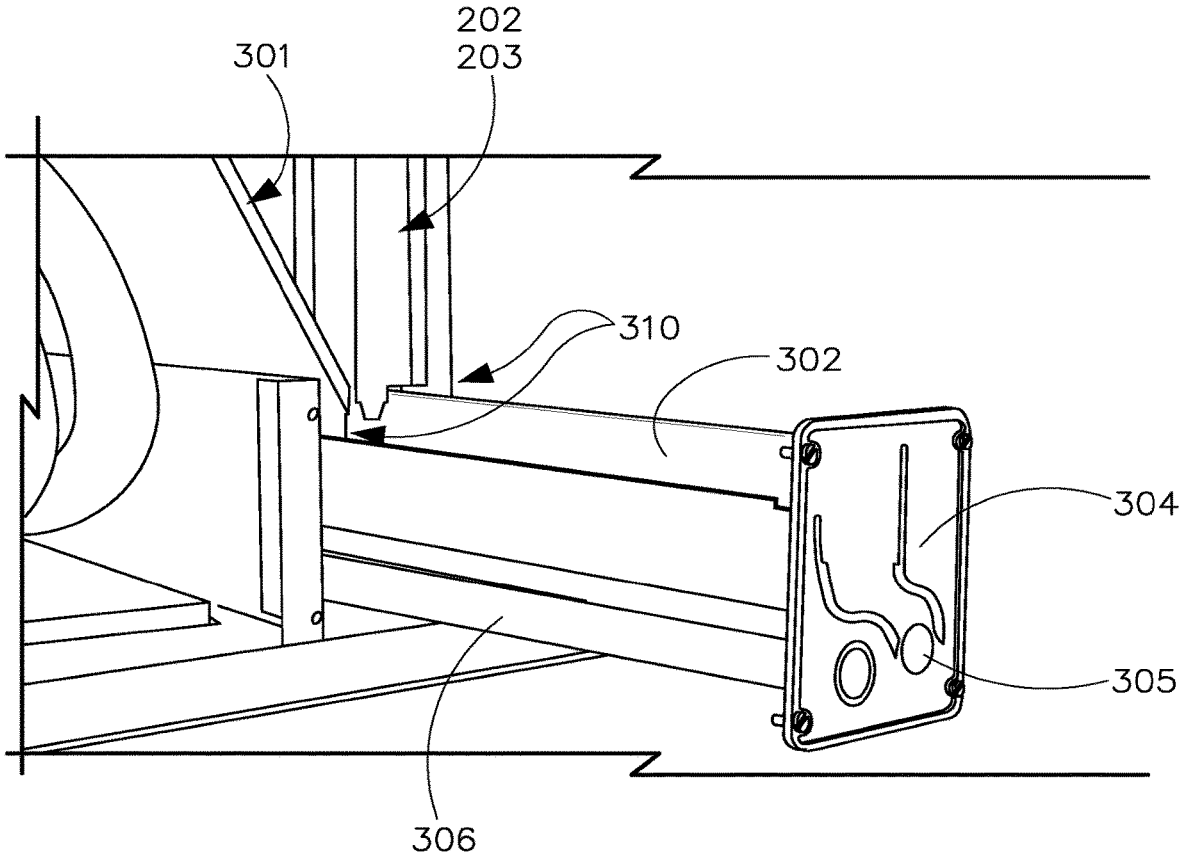
FIGS. 3A and 3B (collectively 'FIG. 3') illustrate an example removable drain pan assembly of the HVAC unit of FIG. 1 with the overflow sensor assembly disposed therein, in accordance with example embodiments of the present disclosure.

As illustrated in FIG. 3, one end of the drain pan 302 may be coupled to a hook end 402 of a blower deck 301 that is configured to support the blower fan assembly 204 thereon, while the other end of the drain pan 302 is coupled to a flange 404 of an evaporator assembly frame 203. In certain embodiments, the hook end 402 may be a substantially J-shaped end portion of the blower deck 301 as illustrated in FIG. 3. The hook end 402 of the blower deck 301 and the flange 404 of the evaporator assembly frame 203 may be disposed in the drain pan cavity 310.

Figure 3B:
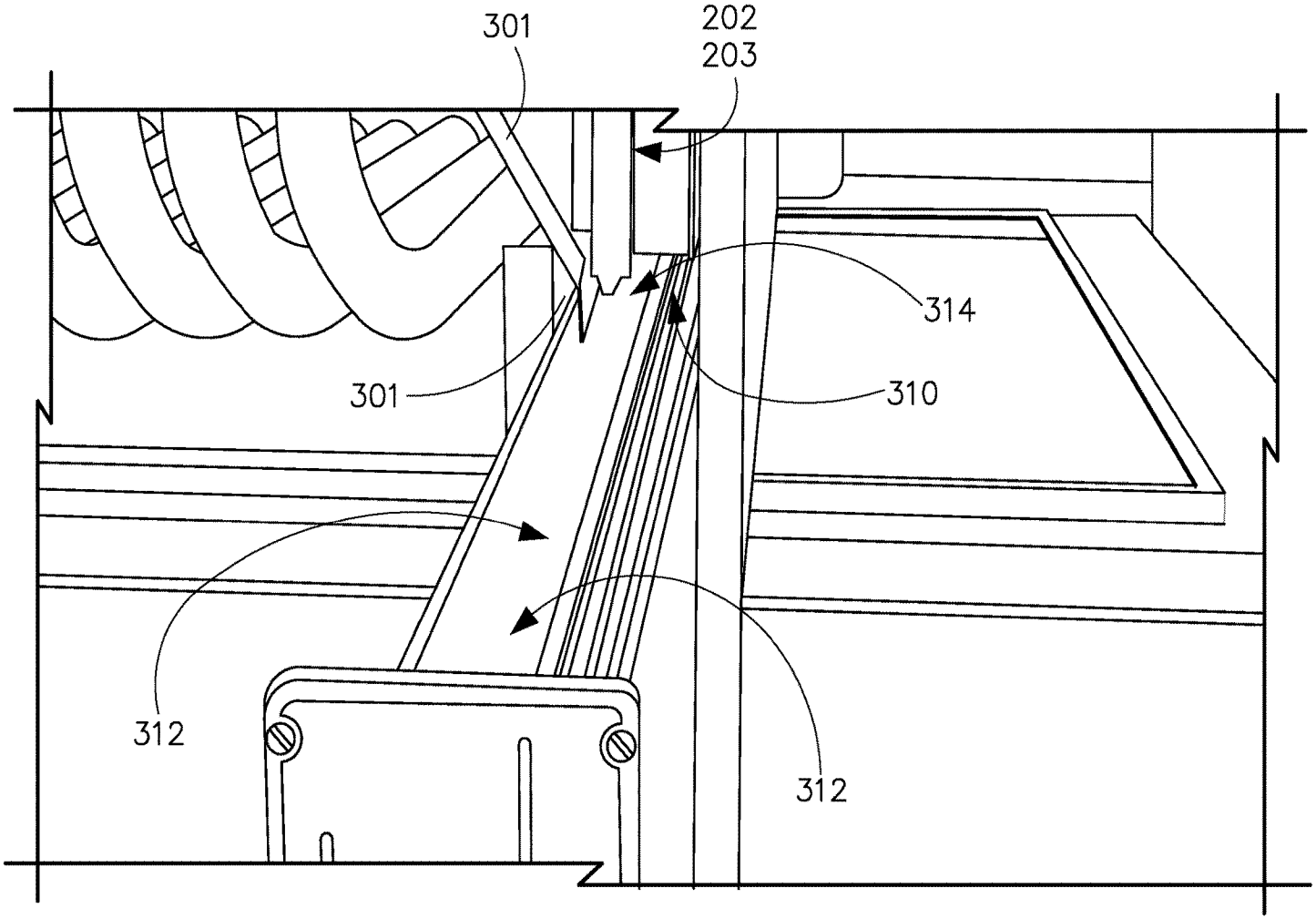

In addition to the removable drain pan assembly 102, the HVAC unit 100 of the present disclosure may include an overflow sensor assembly 314 that is coupled to the hook end 402 of the blower deck 301 such that the sensor probes 411 of the overflow sensor assembly 314 may be disposed in and extend to a certain depth within the condensate drain pan 302 as illustrated in FIG. 3B. In particular, the overflow sensor assembly 314 may include a sensor mounting bracket 406 that is coupled to the hook end 402 of the blower deck 301 using a fastener, such as a screw 313.

Figure 5:
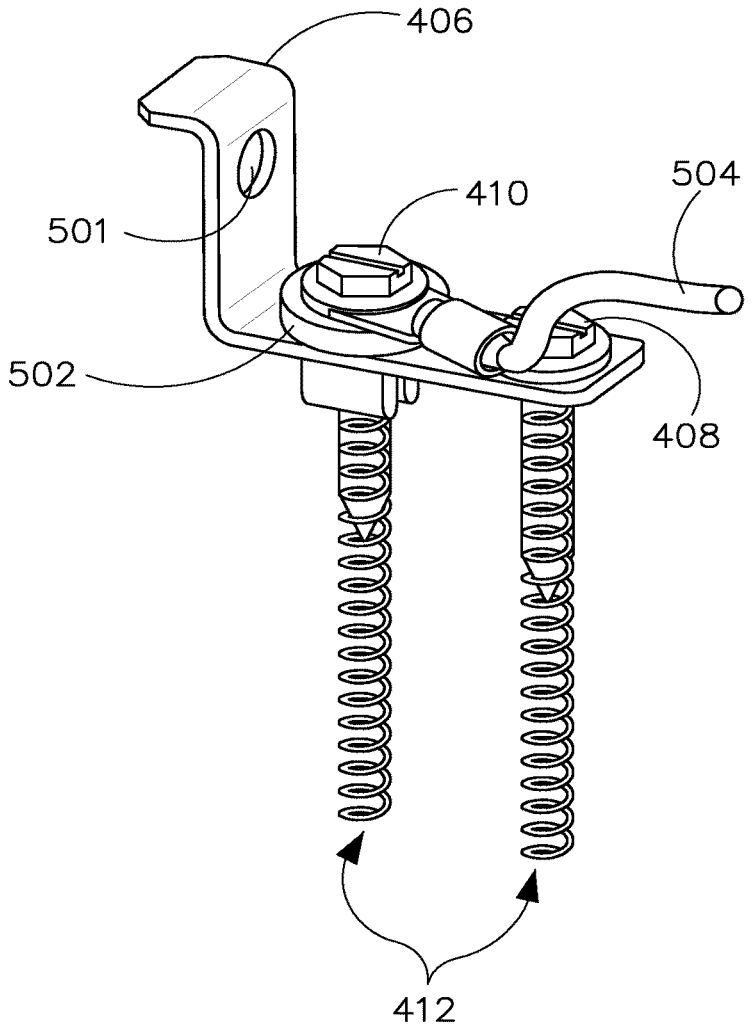
FIG. 5 illustrates a first example overflow sensor assembly that is flexible to accommodate the removable drain pan assembly, in accordance with example embodiments of the present disclosure.

As illustrated in FIG. 5, the sensor mounting bracket 406 may include an aperture 501 that is configured to receive the fastener 313 therethrough to couple the sensor mounting bracket 406 to an appropriate mounting surface (e.g., the hook end 402 of the blower deck 301) that allows the sensor probes 411 of the overflow sensor assembly 314 to be disposed within the condensate drain pan 302. Even though the present disclosure describes the sensor mounting bracket 406 as being coupled to the hook end 402 of the blower deck 301, one of skill in the art can understand and appreciate that in other example embodiments, the sensor mounting bracket 406 of the overflow sensor assembly 314 may be mounted at any appropriate location above the condensate drain pan 302 such that the sensor probes 411 of the overflow sensor assembly 314 are disposed at a depth within the condensate drain pan 302 to sense a rising condensate fluid level in the condensate drain pan 302 prior to an overflow of the condensate fluid from the condensate drain pan 302.

Figure 4:
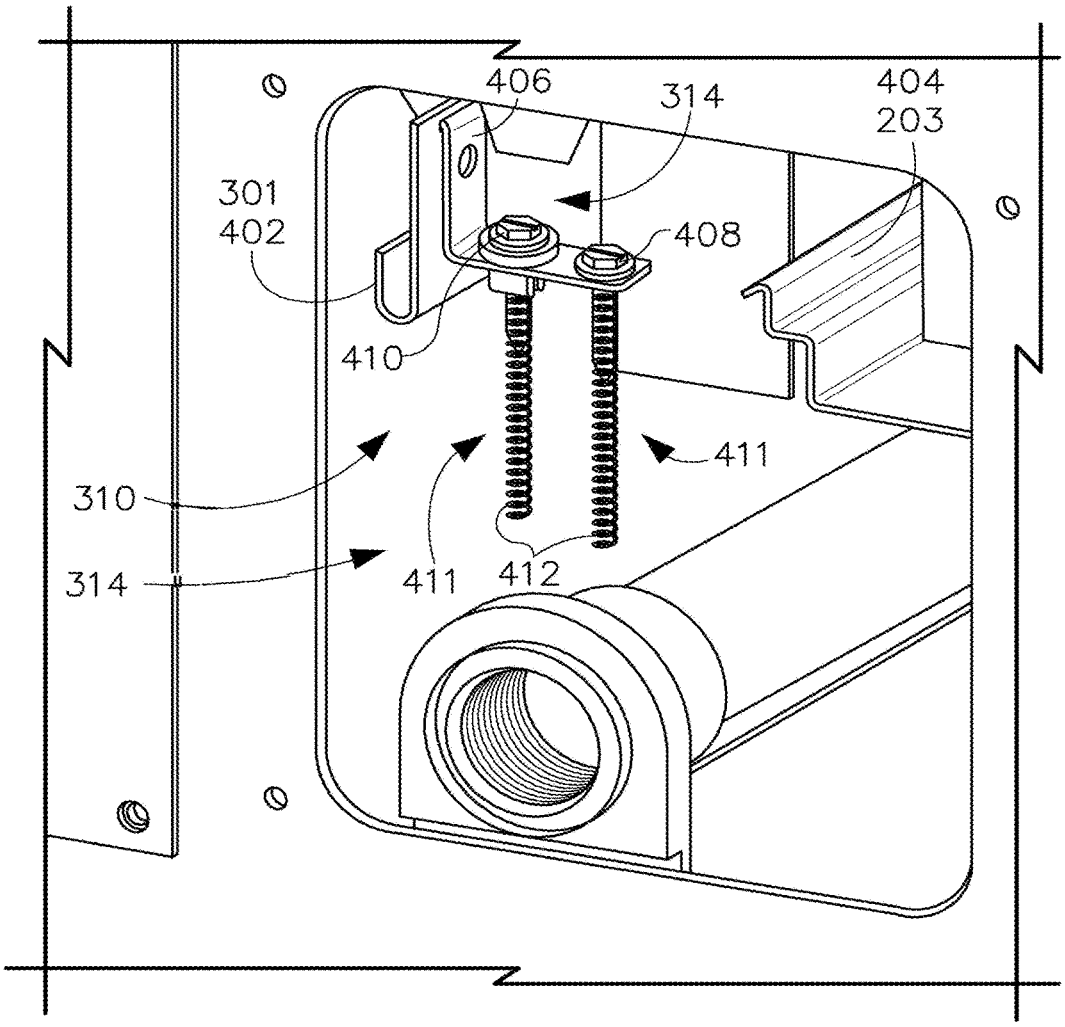
FIG. 4 illustrates an enlarged view of drain pan cavity of the HVAC unit of FIG. 1 with the removable drain pan assembly having been removed, in accordance with example embodiments of the present disclosure.

In certain embodiments, the sensor mounting bracket 406 may be a substantially L-shaped bracket as illustrated in FIGS. 4 and 5. In such embodiments, one leg of the L-shaped bracket may be used to mount the sensor mounting bracket 406 to an appropriate mounting surface as described above, while the other leg of the L-shaped bracket may be configured to support and mount the sensor probes 411 thereon. The sensor probes 411 of the overflow sensor assembly 314 may be configured to close an overflow sensing circuit or create circuit continuity when the sensor probes 411 come in contact with the condensate fluid. Closing the overflow sensing circuit when the sensor probes 411 contact the condensate fluid may in turn cause an overflow alert signal (or alarm) to be generated and transmitted to the HVAC unit 100. Additionally, in some embodiments, the operation of the HVAC unit 100 may be shut off to prevent further generation of condensate fluid when the overflow sensing circuit is closed.

In one example embodiment, as illustrated in FIGS. 3B, 4, and 5, the sensor probes 411 may include a pair of screws (408, 410) that extend through corresponding openings in the sensor mounting bracket 406 and/or metal springs 412 that are threaded to the screws (408, 410). The first screw 410 may be coupled to a power supply, e.g., 24 V power supply via a wire assembly 504, while the second screw 408 may be grounded. The metal springs 412 (e.g., helical springs) may be threaded to the screws until the metal springs on both the screws (408, 410) have an equal insertion depth and are flush across the bottom. The metal springs 412 may be adjusted, e.g., rotated clockwise or anti-clockwise, to adjust the insertion depth at which the bottom tips of the metal springs 412 are disposed. The insertion depth at which the bottom tips of the metal springs 412 are disposed may determine the depth or the level at which the condensate fluid in the condensate drain pan 302 will be detected and cause the overflow sensing circuit to close and shut down the operation of the HVAC unit 100. Shutting down the operation of the HVAC unit 100 may include shutting down a current operation cycle, e.g., a current heating or cooling cycle of the HVAC unit 100.

The first screw 410 that is coupled to the power supply via the wire assembly 504 may be coupled to the sensor mounting bracket 406 of the overflow sensor assembly 314 via a grommet nut 502, e.g., nylon grommet nut such that the first screw 410 is raised or positioned at a higher level than the second screw 408. In certain embodiments, placing the first screw 410 at a higher level or elevation than the second screw 408 using the grommet nut 502 may prevent a false overflow detection from any condensate fluid that drips on the sensor mounting bracket 406 between the screw heads of the sensor probes 411.

The metal springs 412 that are threaded to the screws (408, 410) operate as an extension of the sensor probes 411. That is, the tip of the metal springs 412 may define the tip of the sensor probes 411. In addition to operating as the extension of the sensor probes 411, the metal springs 412 make the sensor probes 411 flexible to allow the removable drain pan assembly 102 to easily slide in and slide out. For example, if any portion of the condensate drain pan 302 engages the metal springs 412 of the sensor probes 411, the metal springs 412 may deflect to allow said portion of the condensate drain pan to move past the sensor probes 411 and then the metal springs 412 return back to their default position as illustrated in FIGS. 3B, 4, and 5. In other words, the metal springs 412 of the sensor probes 411 move or deflect if there is any interference with the sliding removable drain pan assembly 102 to allow the removable drain pan assembly 102 to slide past the sensor probes 411.

Figure 6:
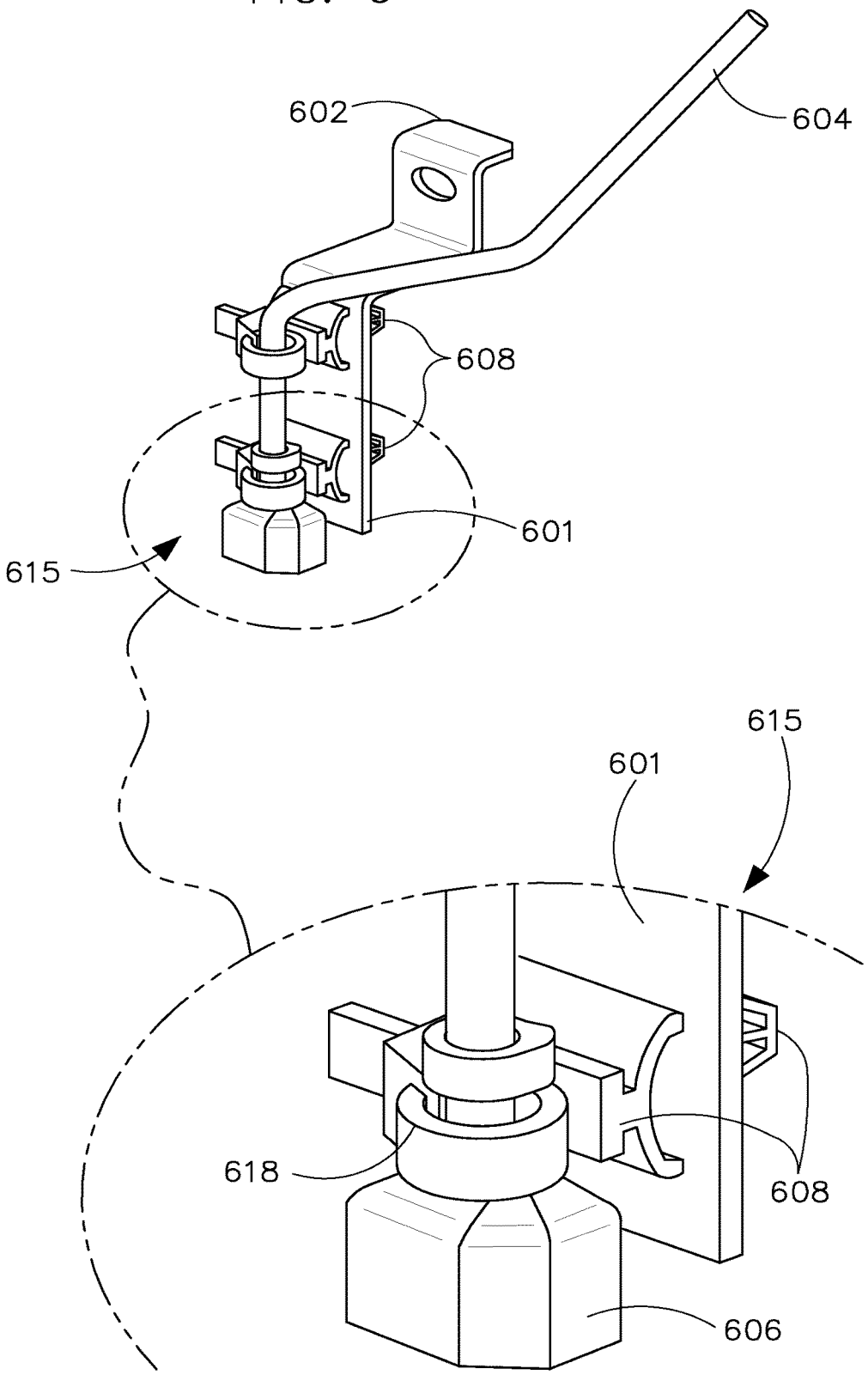
FIG. 6 illustrates a second example overflow sensor assembly that is rigidly mounted to a flexible mount to accommodate the removable drain pan assembly, in accordance with example embodiments of the present disclosure.

Even though FIGS. 3B, 4, and 5 illustrate an overflow sensor assembly 314 having metal springs 412 that are flexible, one of skill in the art can understand and appreciate that in other example embodiments, the sensor probes 411 may not include the metal springs 412 provided the removal of the removable drain pan assembly 102 does not interfere with the sensor probes 411 of the overflow sensor assembly 314. For example, the sensor probes 411 of the overflow sensor assembly 314 illustrated in FIGS. 3B, 4, and 5 may not include the metal springs 412. Instead, the sensor probes 411 may only include the screws (408, 410). In another example embodiment illustrated in FIG. 6, the overflow sensor assembly 314 may include sensor probes that are defined by: (i) a metal leg 601 that is coupled or integral to and extending down from an edge of the substantially L-shaped sensor mounting bracket 602, and (ii) a wire 604 that is coupled to the metal leg 601 using wire tabs or stand-off tabs 608 such that the wire is separated from the metal leg 601 by a distance and extends down into the condensate drain pan 302. The wire 604 includes a termination 606 at the end. The termination 606 at the end of the wire 604 forms one probe while the metal leg 601 forms the other probe that create circuit continuity when the termination 606 and the metal leg 601 contact the condensate fluid in the condensate drain pan 302. In certain example embodiments, one of the wire tabs or stand-off tabs 608 may include a push mount tie that may be secured around a neck of the termination 606 to securely hold the termination in place, as shown in FIG. 6.

Figure 7A:
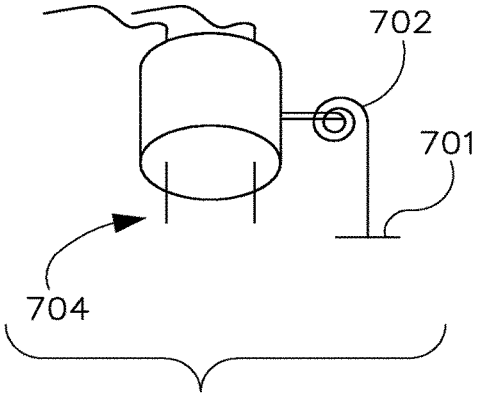
FIGS. 7A, 7B, 7C, and 7D (collectively 'FIG. 7') illustrate additional example overflow sensor assemblies that are flexible to accommodate the removable drain pan assembly, in accordance with example embodiments of the present disclosure.
Figure 7C:
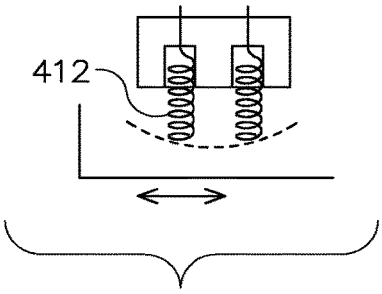
Figure 7B:
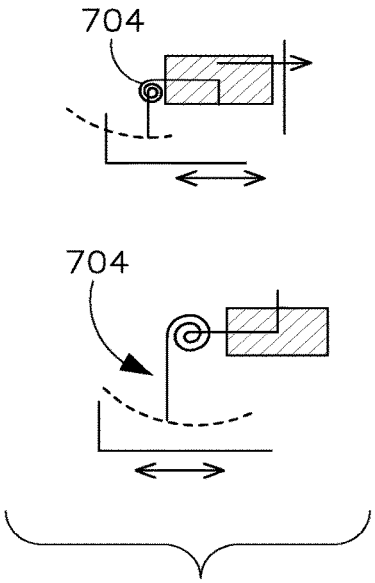
Figure 7D:
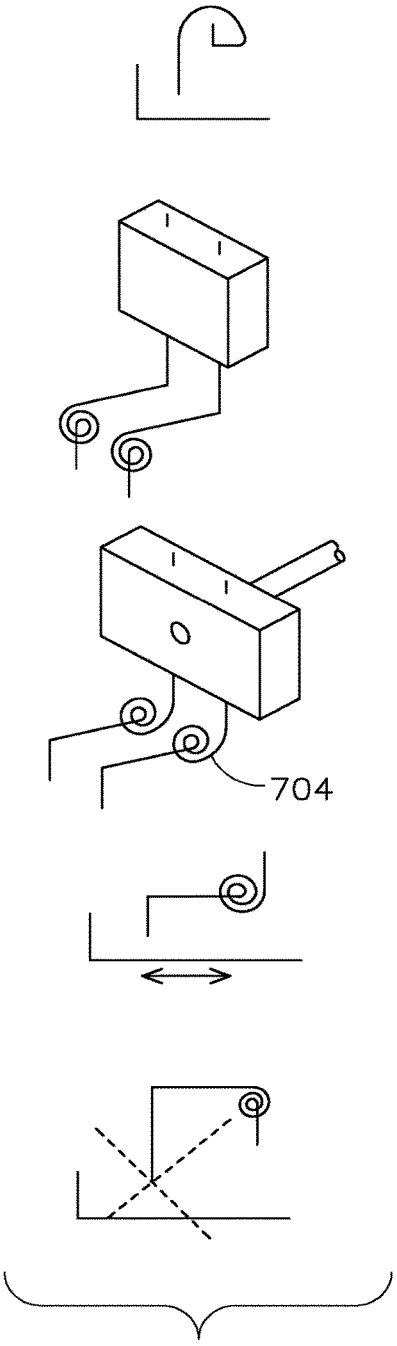
Figure 8:
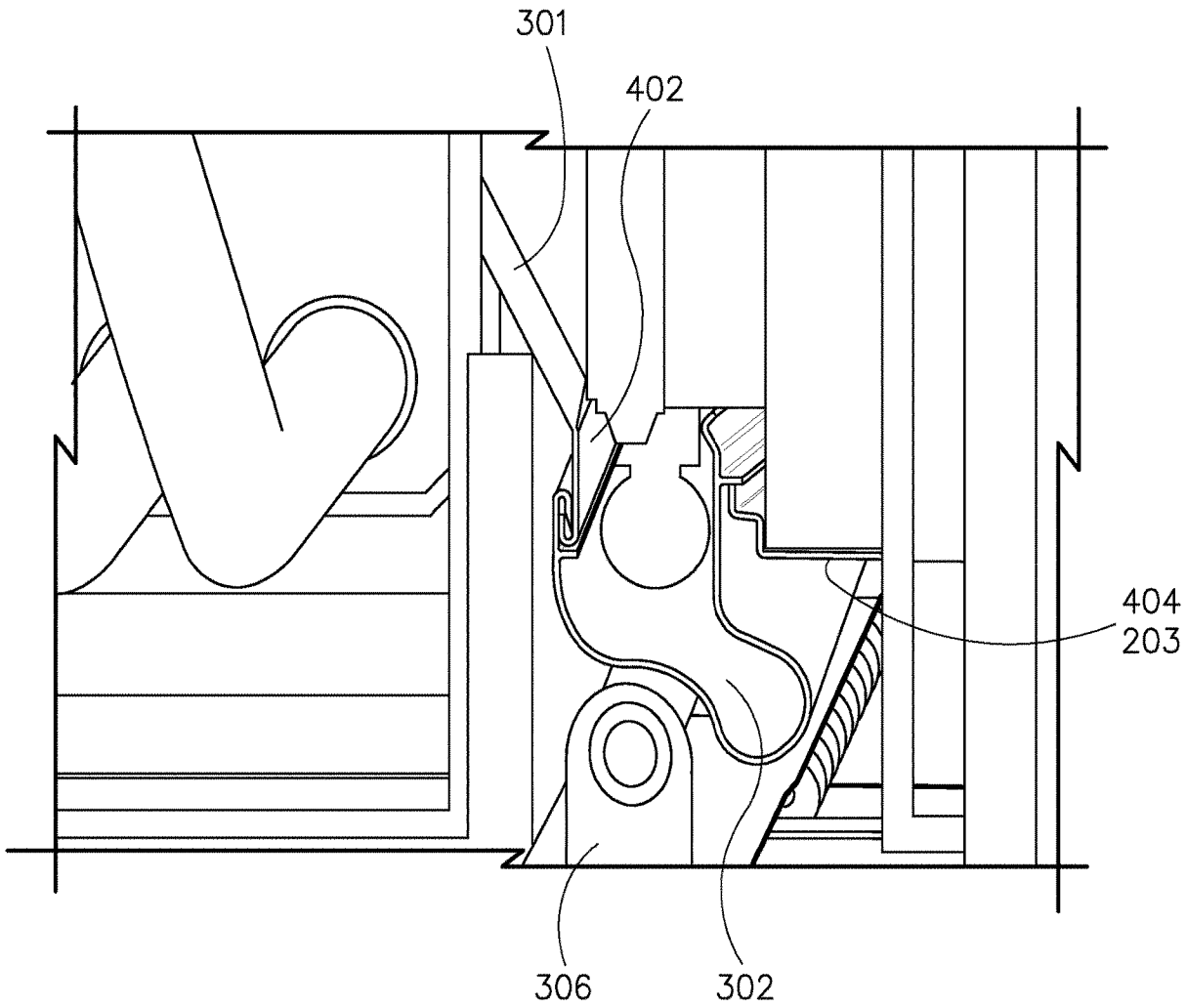
FIG. 8 illustrates a cross-sectional view of the removable drain pan assembly, in accordance with example embodiments of the present disclosure.

Even though FIGS. 3B, 4, and 5 illustrate an overflow sensor assembly 314 having metal springs 412 that are flexible and are threaded onto screws to form the sensor probes, in some example embodiments, as illustrated in embodiments B and D of FIGS. 7B and 7D, any other appropriate spring type 704, such as torsion springs may be coupled to the screws or other such sensor elements to form an extension of the sensor elements and to define the sensor probes. Further, even though FIGS. 3B, 4, and 5 illustrate an overflow sensor assembly 314 having metal springs 412 that are flexible and are threaded onto screws to form the sensor probes, in some example embodiments, such as the one illustrated in embodiment A of FIG. 7A, a rigid sensor 704 may be coupled to an end of a spring assembly 702 (e.g., torsion spring) that is mounted to a mounting bracket 701 at an opposite end. The spring assembly 702 may be configured to flex and deflect which in turn causes the rigid sensor probes 704 to move when they interfere with the sliding removable drain pan assembly 102.

Further, in some example embodiments, such as the embodiment illustrated in FIG. 7C, the sensor mounting bracket 406 may be pivotally coupled to the mounting surface or adjustably coupled to the mounting surface such that the sensor mounting bracket 406 can deflect about a mounting point on the mounting surface without departing from a broader scope of the present disclosure. In certain embodiments, the sensor mounting bracket 602 of FIG. 6 may be adjustably or pivotally coupled to the mounting surface (e.g., hook end 402 of the blower deck 301) or couple to the mounting surface via a torsion spring such as in embodiment A of FIG. 7A such that the sensor mounting bracket 602 and the termination 606 with the wire 604 rotate, move, or deflect if there is any interference with the sliding removable drain pan assembly 102 to allow the removable drain pan assembly 102 to slide past the sensor probes (606, 601).

Although example embodiments are described herein, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

That which is claimed is:

1. An overflow sensor assembly for detecting fluid leaks at a device, the overflow sensor assembly comprising:

a sensor probe configured to be in electrical communication with a power supply; and a sensor mounting bracket that forms a ground, wherein the sensor mounting bracket is configured to be adjustably coupled to a mounting surface on the device, such that the sensor mounting bracket can deflect about the mounting surface;

wherein the sensor probe is suspended from the sensor mounting bracket.

2. The overflow sensor assembly of claim 1, wherein an overflow detection circuit is activated when the sensor probe and the sensor mounting bracket come in contact with a fluid.

3. The overflow sensor assembly of claim 2, wherein the fluid forms a portion of the overflow detection circuit.

4. The overflow sensor assembly of claim 1, wherein the sensor mounting bracket is configured to be pivotally coupled to the mounting surface.

5. The overflow sensor assembly of claim 1, wherein the sensor probe is suspended in a condensate drain pan of the device.

6. The overflow sensor assembly of claim 1, wherein the sensor probe comprises at least one metal spring.

7. The overflow sensor assembly of claim 6, wherein the at least one metal spring is configured to swing in a lateral direction.

8. The overflow sensor assembly of claim 6, wherein the at least one metal spring is coupled to a screw.

9. The overflow sensor assembly of claim 8, wherein an insertion depth of the at least one metal spring is adjustable via rotation of the at least one metal spring with respect to the screw.

10. The overflow sensor assembly of claim 1, wherein the sensor mounting bracket comprises:

a leg portion; and an L-shaped portion, wherein the sensor probe is coupled to the leg portion;

wherein the sensor probe and an end of the leg portion are disposed at a same vertical elevation, and wherein the sensor mounting bracket is separated from the leg portion by a distance.

11. An overflow sensor assembly for use with a device, the overflow sensor assembly comprising:

a sensor probe in electrical communication with an overflow detection circuit of the device; and a sensor mounting bracket in electrical communication with the overflow detection circuit, wherein the sensor mounting bracket is configured to be adjustably coupled to a mounting surface on the device, such that the sensor mounting bracket can deflect about the mounting surface;

wherein the sensor probe is suspended from the sensor mounting bracket.

12. The overflow sensor assembly of claim 11, wherein the overflow detection circuit of the device is closed when the sensor probe and the sensor mounting bracket both come in contact with a condensate fluid.

13. The overflow sensor assembly of claim 12, wherein the condensate fluid forms a portion of the overflow detection circuit.

14. The overflow sensor assembly of claim 11, wherein the sensor mounting bracket is configured to be pivotally coupled to the mounting surface.

15. The overflow sensor assembly of claim 11, wherein the sensor probe is suspended in a condensate drain pan of the device.

16. The overflow sensor assembly of claim 11, wherein the sensor probe comprises at least one metal spring.

17. The overflow sensor assembly of claim 16, wherein the at least one metal spring is configured to swing in a lateral direction.

18. The overflow sensor assembly of claim 16, wherein the at least one metal spring is coupled to a screw.

19. The overflow sensor assembly of claim 18, wherein an insertion depth of the at least one metal spring is adjustable via rotation of the at least one metal spring with respect to the screw.

20. The overflow sensor assembly of claim 11, wherein the sensor mounting bracket comprises:

a leg portion; and an L-shaped portion, wherein the sensor probe is coupled to the leg portion;

wherein the sensor probe and an end of the leg portion are disposed at a same vertical elevation, and wherein the sensor mounting bracket is separated from the leg portion by a distance.

* * * * *